US010465450B2

(12) United States Patent
Guelaz et al.

(10) Patent No.: US 10,465,450 B2
(45) Date of Patent: Nov. 5, 2019

(54) ELECTROMAGNETIC COUPLER

(75) Inventors: Rachid Guelaz, Saint Maur des Fosses (FR); Yvan Boudey, Paris (FR); Vincent Buchoud, Boulogne-Billancourt (FR); Francois Millet, Antony (FR)

(73) Assignee: Tuboscope Vetco (France) SAS (FR)

( * ) Notice: Subject to any disclaimer, the term of this patent is extended or adjusted under 35 U.S.C. 154(b) by 1501 days.

(21) Appl. No.: 14/000,806

(22) PCT Filed: Feb. 22, 2012

(86) PCT No.: PCT/EP2012/053004

§ 371 (c)(1),
(2), (4) Date: Nov. 1, 2013

(87) PCT Pub. No.: WO2012/113825

PCT Pub. Date: Aug. 30, 2012

(65) Prior Publication Data

US 2014/0041945 A1 Feb. 13, 2014

Related U.S. Application Data

(60) Provisional application No. 61/536,817, filed on Sep. 20, 2011.

(30) Foreign Application Priority Data

Feb. 22, 2011 (FR) ..... 11 00523

(51) Int. Cl.
*E21B 17/02* (2006.01)
*H01F 38/14* (2006.01)

(52) U.S. Cl.
CPC ..... *E21B 17/028* (2013.01); *E21B 17/02* (2013.01); *H01F 38/14* (2013.01); *H01F 2038/143* (2013.01)

(58) Field of Classification Search
CPC ..... H01F 38/14; H01F 2038/14; H01F 2038/143; E21B 17/028; E21B 17/02
See application file for complete search history.

(56) References Cited

U.S. PATENT DOCUMENTS 4,928,088 A 5/1990 Jorion et al.
6,392,317 B1 5/2002 Hall et al.
(Continued)

FOREIGN PATENT DOCUMENTS

| | | |
|---|---|---|
| GB | 2 445 207 | 7/2008 |
| JP | 61 268010 | 11/1986 |
| WO | 2005 031770 | 4/2005 |

OTHER PUBLICATIONS

U.S. Appl. No. 14/234,785, filed Jan. 24, 2014, Millet, et al.
International Search Report dated Jul. 17, 2012 in PCT/EP12/053004 filed Feb. 22, 2012.

*Primary Examiner* — Brad Harcourt
(74) *Attorney, Agent, or Firm* — Conley Rose, P.C.

(57) ABSTRACT

An electromagnetic coupler includes first and second coupling elements for mounting on respective first and second support elements. The first and second coupling elements include respective first and second annular bodies each including a high magnetic permeability material that houses a conductive winding and an open transverse section. The first and second bodies have complementary shapes that when two support elements respectively receiving the first and second coupling elements are coupled, the first and second bodies form a structure enclosing the first and second conductive windings. The first and second conductive windings are respectively positioned in the first and second bodies such that respective surfaces of the first and second conductive windings are substantially parallel when two support elements respectively receiving the first and second coupling elements are coupled.

19 Claims, 9 Drawing Sheets

(56) References Cited

U.S. PATENT DOCUMENTS

| | | | | |
|---|---|---|---|---|
| 6,866,306 | B2 * | 3/2005 | Boyle | E21B 17/028 166/66.5 |
| 7,847,671 | B1 | 12/2010 | Riachentsev et al. | |
| 9,157,313 | B2 * | 10/2015 | Madhavan | E21B 17/028 |
| 2001/0035288 | A1 | 11/2001 | Brockman et al. | |
| 2004/0094303 | A1 | 5/2004 | Brockman et al. | |
| 2007/0024575 | A1 | 2/2007 | Makuth et al. | |
| 2008/0159077 | A1 | 7/2008 | Madhavan et al. | |
| 2010/0052941 | A1 * | 3/2010 | Madhavan | E21B 4/02 340/854.8 |
| 2011/0315399 | A1 * | 12/2011 | Rodney | E21B 17/028 166/380 |
| 2013/0319768 | A1 * | 12/2013 | Madhavan | E21B 17/028 175/50 |
| 2015/0167400 | A1 * | 6/2015 | Rodney | E21B 17/028 166/380 |

* cited by examiner

ELECTROMAGNETIC COUPLER

BACKGROUND

The invention relates to the field of electromagnetic coupling applied to the field of exploration and working oil or gas fields in which mutually communicating drill strings are used, constituted by tubular components such as standard drill pipes, which may be heavy weight, and other tubular elements, in particular drill collars in the bottom hole assembly, connected together end-to-end as required by the drilling process Drilling for oil and the pipeline field are fields in which the transmission of information has become a determining element.

However, certain cutting edge industrial fields such as drilling for oil have operational environments that render data transmission difficult.

As an example, in the context of drilling for oil, measurement means are disposed at the deepest tubes of the drill string. Such measurement devices are used to pick up data pertaining to the drilling environment, especially with a view to directing the drilling.

Bringing that data to the surface is a major problem because the operating environment for such tubes is hostile and renders the use of conventional telecommunication means impossible.

The operational environment in fact poses many problems as regards the supply of the various elements. Furthermore, that environment is also the source of numerous interferences which perturb the signal along the tube string.

Two principal technologies have been developed in response.

The first of those technologies consists of sending the data through the mud moving in the string via sound waves. That method has proved to be highly insufficient in terms of rate, as it can only offer rates of the order of one to a few bits per second.

The second technology, which is still being developed, uses cabled tubular connections coupled to techniques for coupling by magnetic induction. Thus, a coupling element is disposed at each end of each tube, and a wire connects the coupling elements of each tube. It is then possible to transmit the signal from tube to tube along the string, the coupling elements at the end of two successive tubes ensuring transmission between those two tubes.

That technology can be used to increase the rates to a few kilobits per second. However, that increase in rate is at the expense of limited reliability. Further, the losses at each pair of coupling elements of consecutive tubes are high, which means that a lot of supply repeaters have to be included in the string in order to amplify the signal level. Such repeaters are expensive, difficult to maintain and are difficult to incorporate into the design of the drill stem.

In the pipeline field, the operating environment is also very aggressive, and of little use to wireless communications. Thus, it is still necessary to provide cabled connections.

In order to connect two cabled portions of a unit, a coupler then becomes necessary. However, couplers with contacts suffer from many disadvantages in an aggressive environment. In response to this problem, contactless couplers have been developed. However, such couplers cannot be used to obtain good performances in transmission.

In the prior art, the documents GB-2445207, US-2004-0094303, U.S. Pat. No. 6,392,317 and US-2010-0052941 disclose various solutions for coupling drill strings together.

Currently, no coupler, with or without contact, is satisfactory for the transmission of information over long distances in a hostile environment.

BRIEF SUMMARY

The aim of the invention is to improve this situation.

To this end, the invention proposes an electromagnetic coupler comprising a first coupling element for mounting on a first support element and a second coupling element for mounting on a second support element. The first coupling element comprises a first annular body formed at least in part from a high magnetic permeability material which houses a first conductive winding and which has an open transverse section, and the second coupling element comprises a second annular body formed at least in part from a high magnetic permeability material which houses a second conductive winding and which has an open transverse section.

The first body and the second body have complementary shapes such that when two support elements respectively receiving the first coupling element and the second coupling element are coupled, the first body and the second body form a structure enclosing the first conductive winding and the second conductive winding. The first conductive winding and the second conductive winding are respectively positioned in the first body and in the second body such that the respective surfaces of the first conductive winding and the second conductive winding are substantially parallel when two support elements respectively receiving the first coupling element and the second coupling element are coupled.

More particularly, the invention proposes an assembly of at least two tubular drill string components for drilling a hole with movement of a drilling fluid, comprising:

- a first tubular component comprising a first end having a first threading;
- a second tubular component comprising a second end having a second threading intended to cooperate with the first threading in a coupled state; and
- an electromagnetic coupler, such that the electromagnetic coupler comprises a first coupling element for mounting on a first support element disposed at the first end, and a second coupling element for mounting on a second support element disposed at the second end;

the first coupling element comprising a first annular body formed at least in part from a high magnetic permeability material which houses a first conductive winding and which has an open transverse section;

the second coupling element comprising a second annular body formed at least in part from a high magnetic permeability material which houses a second conductive winding and which has an open transverse section;

the first body and the second body having complementary shapes such that when two support elements respectively receiving the first coupling element and the second coupling element are coupled, the first body and the second body form a structure enclosing the first conductive winding and the second conductive winding;

characterized in that the first conductive winding and the second conductive winding are respectively positioned in the first body and in the second body such that the respective surfaces of the first conductive winding and the second conductive winding are substantially parallel when two support elements respectively receiving the first coupling element and the second coupling element are coupled.

Advantageously, the first conductive winding has a substantially flat or cylindrical surface facing the opening of the transverse section of the first body, the second conductive winding may have a substantially flat or cylindrical surface facing the opening of the transverse section of the second body, and in which these surfaces then form the respective surfaces of the substantially parallel first conductive winding and the second conductive winding when two support elements respectively receiving the first coupling element and the second coupling element are coupled.

In other words, the first conductive winding and the second winding may be flat and disposed parallel to each other when the first tubular component is coupled to the second tubular component. Alternatively, the first conductive winding and the second conductive winding may have a substantially cylindrical surface such that the windings are disposed concentrically with respect to each other when the first tubular component is coupled to the second tubular component.

As an example, the transverse section of at least one of the first body and the second body may have a general shape selected from the group comprising a square bracket, a "U", an "L", a "J", an "E" or a "V".

In particular, the first body and the second body have respective end chamfers and in which the chamfers of the first body are substantially facing at least certain of the chamfers of the second body when two support elements respectively receiving the first coupling element and the second coupling element are coupled.

Advantageously, the surfaces of the first body and the second body may face each other when two support elements respectively receiving the first coupling element and the second coupling element are coupled are at a distance from each other which is in the range 100 μm to 500 μm.

As an example, the first conductive winding and the second conductive winding may comprise a conductor selected from the group comprising a copper winding, a copper winding coated with an insulating coating, a printed circuit, and a printed circuit coated with an insulating coating.

Depending on the embodiment, the first conductive winding and the second conductive winding may comprise in the range one to ten turns in cross section.

As an example, the strips or turns of the first conductive winding are substantially aligned, superimposed, with the strips or turns of the second conductive winding when two support elements respectively receiving the first coupling element and the second coupling element are coupled.

In particular, a winding, preferably both windings, may comprise two turns with reverse orientations disposed on a body comprising at least one arm between said two turns.

Preferably, in the coupled state, the first conductive winding and the second conductive winding may be disposed at a distance in the range 0.5 mm to 5 mm with respect to each other.

As an example, at least one of the first body and the second body is coated with an element, component or coating comprising a ceramic comprising $ZrO_2$ or $Al_2O_3$ or $Cr_2O_3$.

As an example, at least one of the first body and the second body comprises a plurality of ring segments formed from a high magnetic permeability material received in an annular support.

In particular, the annular support may comprise a material selected from the group comprising silicone, a hydrogenated nitrile rubber, a fluoroelastomer, a perfluoroelastomer or an ethylene-propylene-diene monomer or from the group comprising titanium, amagnetic stainless steel and zirconium.

More particularly, the high magnetic permeability material may have a relative magnetic permeability of more than 100 in the 1 kHz to 10 MHz band. It may be formed from a ceramic comprising MnZn; for example, it may be a soft ferrite.

The electromagnetic coupler proposed is particularly advantageous as it means that low loss signal transmission can be achieved over a very broad frequency band of one or more MHz, since the area of the facing surfaces is high.

This means that rates of several hundred kilobits per second to several megabits per second can be obtained, while limiting the need for repeaters.

BRIEF DESCRIPTION OF THE DRAWINGS

Other characteristics and advantages of the invention will become clearer from the following description of examples given by way of non-limiting illustration, with reference to the drawings in which.

DETAILED DESCRIPTION

The following drawings and description essentially contain distinct elements. Thus, they not only serve to provide a better understanding of the present invention but also, if necessary, contribute to its definition.

Figure 1A:
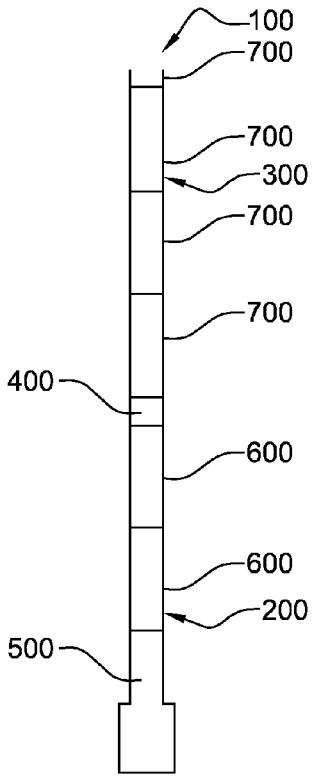
FIG. 1*a* shows a diagrammatic view of a drill string comprising at least one assembly of the invention.

As can be seen in FIG. 1*a*, a drill string 100 comprises a bottom hole assembly 200 and a drillpipe string 300. The bottom hole assembly 200 and the drillpipe string 300 are, for example, connected via a connection element 400. The bottom hole assembly 200 may comprise a drill bit 500 and one or more drill collars 600. The large mass of the drill collar or drill collars 600 ensures that the drill bit 500 will bear against the bottom of the hole. The drill pipe 300 comprises a plurality of pipes 700 which may comprise standard pipes obtained by welding a male end of a great length tube that itself has a female end on the side opposite to the male end. When connected, these ends form sealed tubular threaded connections provided with metallic sealing surfaces. A pipe may be of the API, American Petroleum Institute, type 7 or may be in accordance with a manufacturer's own specifications, for example with ends as illustrated in documents U.S. Pat. No. 6,513,840 or 7,210,710 to which reference is invited.

Figure 1B:
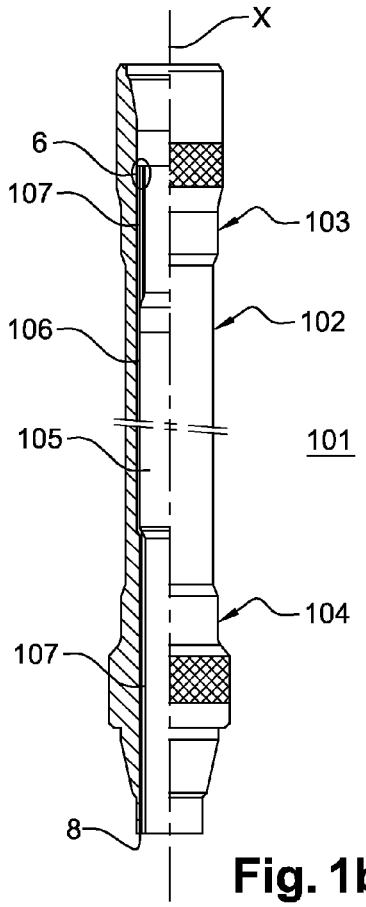
FIG. 1*b* shows a diagrammatic view of a tubular component of an assembly of the invention.

FIG. 1*b* shows a first tubular drilling component 101 which may correspond to a pipe such as 700, a connection element such as 400, or a drill collar such as 600. The tubular component 101 comprises a hollow tubular portion 102 on which, at each of its axial ends relative to the longitudinal axis X of the tubular portion, a respective first end 103 and a second end 104 are held by welding, typically by friction welding. The tubular portion 102 and its ends 103 and 104 have a bore 105 along the longitudinal axis via which mud is moved during the drilling operation. The tubular component may be equipped with a communication cable 106 extending substantially from the first end 103 substantially to the second end 104. In particular, this cable 106 is received in a specific bore 107 respectively formed at each of the ends 103 and 104. The cable 106 is connected at each of its ends to a coupling element.

Figure 1C:
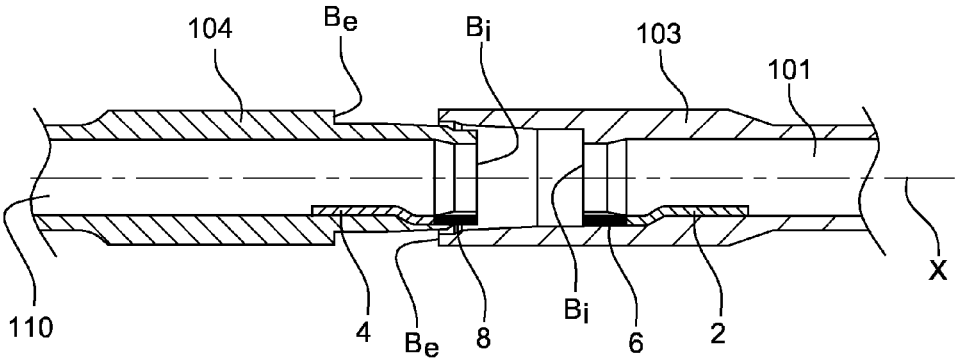
FIG. 1*c* shows a partial diagrammatic view of an assembly of the invention in an uncoupled state wherein the first tubular component is aligned with the same longitudinal axis as the second tubular component.

Conventionally, the first end 103 is a female end and the second end 104 is a male end. As can be seen in FIG. 1*c*, to form an assembly of the invention in the coupled state, a female end 103 of a first tubular component 101 is made up into a male end 104 of a second tubular component 110.

In order to form a communicating drill string assembly of the invention, when a first end 103 of a first tubular component 101 is made up onto the second end such as 104 of the second tubular component 110, then a first coupling element 6 at the first end is coupled to a second coupling element 8 at the second end, so as to ensure continuity of the communications line from one tubular component to another.

Figure 1D:
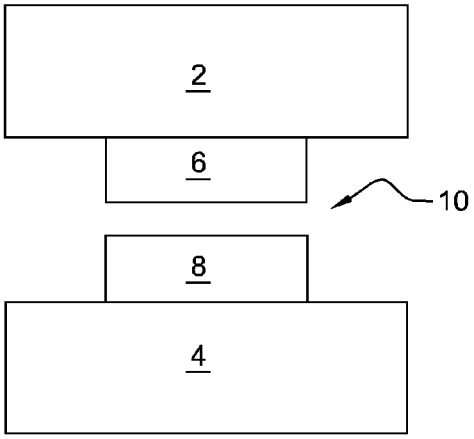
FIG. 1*d* shows a diagrammatic view of an electromagnetic coupler in accordance with the invention.

FIG. 1*d* shows a diagrammatic top view of a device forming a part of an assembly comprising a magnetic coupler as proposed herein.

The device comprises a first support element 2, a second support element 4, the first coupling element 6 and the second coupling element 8. The respective first support element 2 and the second support element 4 are each respectively retained in a housing formed in a tubular component and opening parallel to or laterally to the longitudinal axis X.

The first coupling element 6 is mounted on the first support element 2 and is maintained by means which are not shown. These means may vary, such as fixing means, screw means, nesting means, interference fit means or any other appropriate means. In the same manner, the second coupling element 8 is mounted on the second support element 4 and is maintained by means which are not shown. Said means may be identical to those supporting the first coupling element 6 on the first support element 2, or they may be different.

The first support element 2 and the second support element 4 are disposed with respect to each other such that the first coupling element 6 faces the second coupling element 8.

In this configuration, the first coupling element 6 and the second coupling element 8 have substantially parallel faces, and together define an electromagnetic coupler 10.

The principal role of the first support element 2 and the second support element 4 is to position the first coupling element 6 and the second coupling element 8 with respect to each other in order to optimize the efficiency of the electromagnetic coupler 10. The first tubular component 101 retaining the first support element 2 presents the latter facing the second support element 4 retained on the complementary second tubular component 110 when the connection between these tubular components is made. The tubular components are intended to be connected by makeup.

Preferably, these tubular components comprise at each end an external abutment "Be" and an internal abutment "Bi", the support elements preferably being carried so that they can be coupled at the internal abutments. In the made up state, the internal abutment of the first tubular component is in contact with the internal abutment of the second tubular component. Similarly in this made up state, the external abutment of the first tubular component is in contact with the external abutment of the second tubular component. In a particular embodiment, shown diagrammatically in FIG. 1*c*, the respective support elements 2 and 4 are held against the internal wall of the tubular components.

Figure 2A:
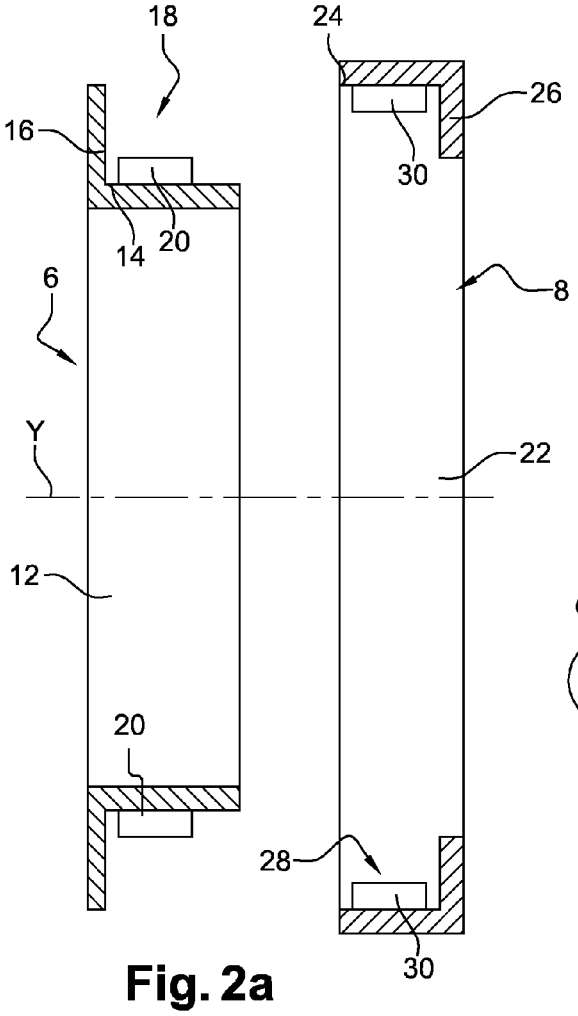
FIGS. 2*a* and 2*b* show radial sectional views of variations of the electromagnetic coupler of FIG. 1.
Figure 2C:
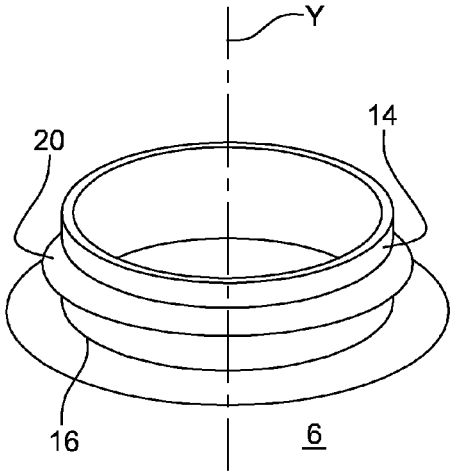
FIG. 2*c* shows a perspective view of a coupling element of the electromagnetic coupler of FIGS. 2*a* and 2*b*.
Figure 2B:
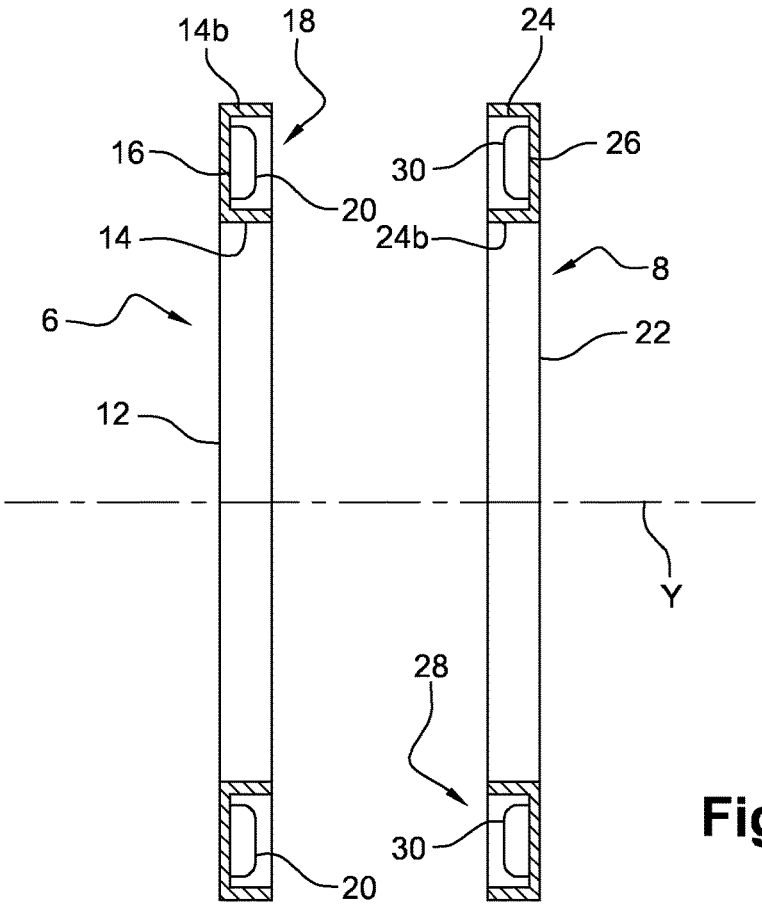

FIGS. 2*a* and 2*b* shows a diagrammatic cross sectional view of the first coupling element 6 and the second coupling element 8 at a distance from each other. The cross section, in the context of the invention, is along a sectional plane passing through the longitudinal axis X of the tubular component and containing a radius of the tubular component.

As can be seen in this Figure, the coupling element 6 comprises an annular body 12. In the example, this longitudinal axis X is superimposed on the axis of revolution Y of the annular body 12. The annular body 12 has a cross section with an arm 14 and an arm 16 which are connected and together form an L. The arm 14 is arranged such that it is substantially parallel to the axis of the body 12, in particular parallel to the axis of revolution Y of the annular body 12. The arm 16 is orthogonal to the axis of revolution Y. The opposed ends of the arms 14 and 16 define an opening 18. The arms 14 and 16 also define annular surfaces, as can be seen in the perspective view of FIG. 2*c*.

The first coupling element 6 also comprises a conductive winding 20. In the example described here, in FIG. 2*a*, a conductive winding 20 is disposed over the entire length of the arm 14 by bonding. The conductive winding 20 forms a winding about an axis substantially parallel to the axis of revolution of the annular body 12. The conductive winding 20 is electrically insulated from the arm 14.

The coupling element 8 is similar to the coupling element 6, and has an annular body 22 with an arm 24 and an arm 26 which are connected and together form an L. The arm 24 is arranged so that it is substantially parallel to the axis of the body 22, in particular parallel to the axis of revolution of the annular body 22. The opposed ends of the arms 24 and 26 define an opening 28. In similar manner to the coupling element 6, the arms 24 and 26 also define mutually orthogonal annular surfaces.

The second coupling element 8 also comprises a conductive winding 30. In the example described here, FIG. 2*a*, the conductive winding 30 is disposed over the whole length of the arm 24 by bonding. The conductive winding 30 forms a winding around an axis substantially parallel to the axis of revolution of the annular body 22.

In the example described in FIG. 2*a*, the openings 18 and 28 open both longitudinally relative to the axis of revolution and radially towards the exterior.

In this embodiment of FIG. 2*a*, the respective conductive windings 20 and 30 are arranged so as to be facing on the circumference of the cylinders, respectively the arms 14 and 24, disposed in a co-linear and concentric manner when the respective tubular components 101 and 110 are connected and made up one into the other.

In a variation, in the example of FIG. 2*b*, the openings 18 and 28, which have the same numbering as in FIG. 2*a*, have an opening that opens only longitudinally relative to the axis of revolution Y of the annular bodies 12 and 22. In addition to that depicted in FIG. 2*a*, the respective annular bodies 12 and 22 each have a respective second annular arm 14*b* and 24*b*, respectively parallel to the arms 14 and 24. Thus the arm 16, respectively 26, is enclosed by the concentric arms 14 and 14*b*, respectively 24 and 24*b*. The annular bodies 12 and 22 preferably have the same external diameter and are assembled so that their respective axes of revolution are co-linear. Thus, the conductive windings disposed, in the embodiment of FIG. 2*b*, on the respective annular arms 16 and 26, may also face each other.

In the example described here, the windings 20 and 30 are produced from a copper conductor covered with an insulating layer. In a variation, these windings could be formed from a material other than copper by means of a printed circuit. In a variation, the windings 20 and 30 are formed by conductive tracks printed into the surface of a substrate, the substrate being formed from epoxy, for example, or from ceramic, or formed from Kapton®, said tracks possibly being wound into turns with no contact between the turns. The substrate is selected to perform well mechanically under pressure and neither break nor crack under such loads.

Figure 3E:
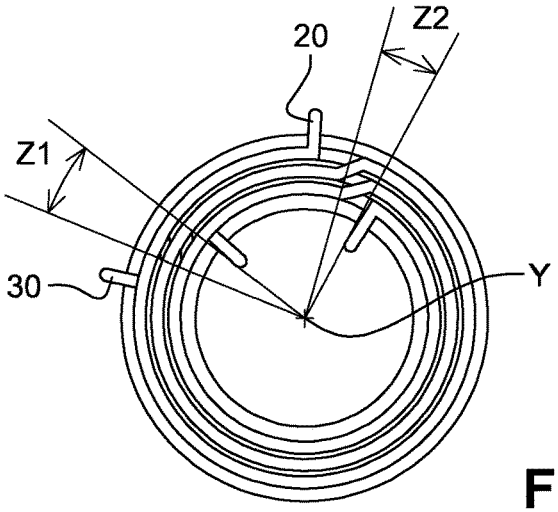
FIG. 3*e* shows the projection along the axis of revolution of the windings of FIG. 3*c* of a coupler of an assembly of the invention, the projection being in a plane perpendicular to said axis of revolution.
Figure 3A:
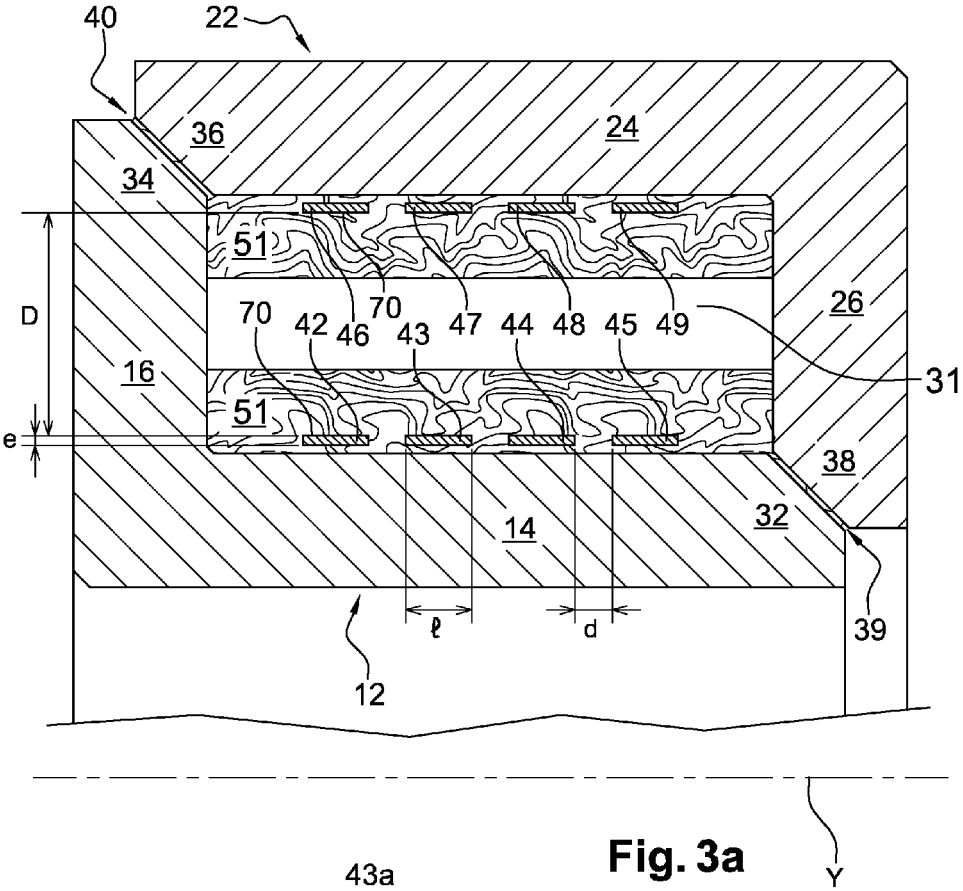
FIG. 3*a* shows a cross sectional view of the electromagnetic coupler of FIG. 1*d* when the two elements supporting it are engaged.

In the representations of FIGS. 2*a* and 3*a*, the substrate on which the turns are formed is cylindrical, so that the respective axial projections of the turns along the Y axis onto a surface perpendicular to said axis of revolution Y are superimposed or concentric. The windings are then known as "cylindrical" turns. In this case, the windings 20 and 30 are disposed on cylinders concentric with the axis of revolution which is preferably a common axis. The windings 20 and 30 are then superimposed radially.

Figure 3B:
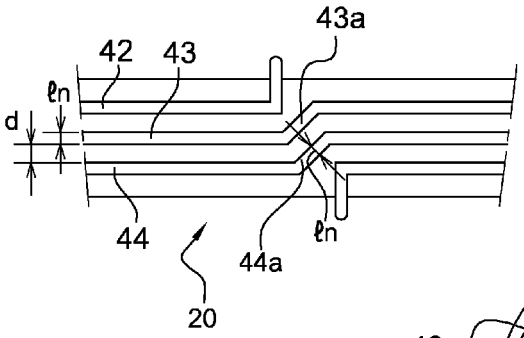
FIG. 3*b* is an enlarged top view of a winding of the type shown in FIG. 3*a*.
Figure 3C:
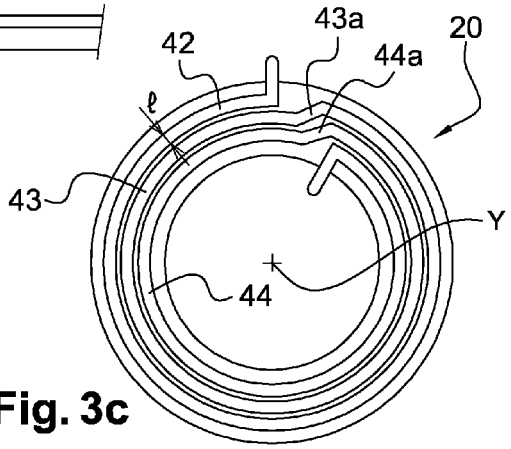
FIG. 3*c* shows a variation of a winding.
Figure 3D:
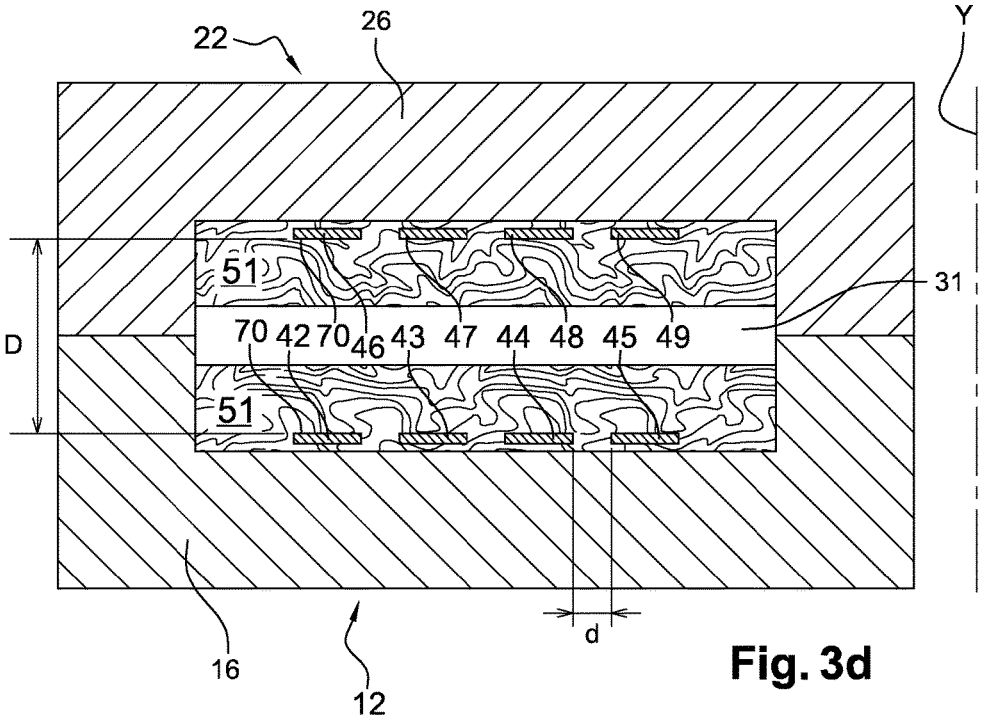
FIG. 3*d* shows a cross sectional view of a variation of a coupler.

Alternatively, in the embodiment of FIGS. 2*b* and 3*d*, the substrate is a flat ring, such that the turns of a winding do not overlap axially along their winding axis Y. In this case, the conductive tracks are substantially disposed in the same plane and the winding is known as a "flat" winding. Such a flat winding is such that its projection onto a plane perpendicular to its winding axis does not have superimposed turns.

Advantageously, said windings 20 and 30 may be produced by means of any conductor with a shape such that one of its surfaces is very large with respect to its thickness. In the embodiment described here, this ratio is 4 or more.

When the windings 20 and 30 are cylindrical, this thickness "e" is measured radially relative to the axis of revolution of the cylinder, and have a width "l" corresponding to the height of one turn along this axis of revolution of the cylinder. In this configuration, the width to thickness ratio is 4 or more.

When the windings 20 and 30 are flat, this thickness "e" is method along the axis of the winding, in a sectional plane passing through its winding axis, and its width "l" is measured radially perpendicular to the axis of the winding. In this configuration, the width to thickness ratio is 4 or more.

Preferably, the windings 20 and 30 comprise at least two turns such that the section of said winding in a sectional plane passing through its winding axis comprises at least four turn sections.

Furthermore, the windings 20 and 30 may be disposed on their respective arm by depositing a printed circuit or by any other appropriate fixing means, such as an interference fit, a groove in the arm or something else.

In the example described here, the body 12 and the body 22 are produced from a ceramic comprising MnZn. This material is also known as "soft ferrite" and its generic formula is $Mn_aZn_{(1-a)}Fe_2O_4$. This material has a relative magnetic permeability $\mu_r$ of several hundred in the range 500 kHz to 2 MHz. Further, this ceramic has a very high electrical resistance. In a variation, the body 12 and the body 22 could be formed from another type of ferrite, or from another solid material with a relative magnetic permeability of more than 100 in the 1 kHz to 10 MHz band, and with a negligible or zero electrical conductivity.

The principal difference between the coupling elements 6 and 8 resides in that the transverse section of the coupling element 6 is substantially symmetrical with the transverse section of the coupling element 8 with respect to a straight line which passes through the opposed ends of the arms 14 and 16. Thus, when the first support element 2 and the second support element 4 are engaged, the bodies 12 and 22 face each other, as do the conductive windings 20 and 30. In this position, the bodies 12 and 22 surround the windings 20 and 30.

FIG. 3*a* shows a sectional view of the first coupling element 6 and the second coupling element 8 when the first support element 2 and the second support element 4 are engaged.

As can be seen in this figure, the body 12 and the body 22 make up to produce a substantially rectangular contour in section which surrounds the windings 20 and 30 and defines a space 31. Thus, the shapes of the bodies 12 and 22 are termed "complementary".

In the assembled position of the support elements 2 and 4, the bodies 12 and 22 define a structure that encloses the conductive windings 20 and 30. When being assembled, the bodies 12 and 22 are brought into mutual proximity and define an almost closed chamber respectively bordered by the arms 14, 16, 26 and 24, corresponding to this space 31. This chamber is annular. This chamber is not necessarily arranged in a sealed manner.

In this embodiment, the arms 14, 16, 24 and 26 each have a respective chamfer 32, 34, 36 and 38. The chamfers 32, 34, 36 and 38 are produced such that the chamfers 32 and 38 and respectively 34 and 36 substantially face each other when the first support element 2 and the second support element 4 come into engagement. The chamfers 32, 34, 36 and 38 form tapered surfaces.

The arms 14 and 26 and respectively 16 and 24 do not come into contact with each other, and so a space 39 and respectively a space 40 separate these arms at the chamfers 32 and 38 and respectively 34 and 36. The role of the spaces 39 and 40 will be explained below.

Figure 4:
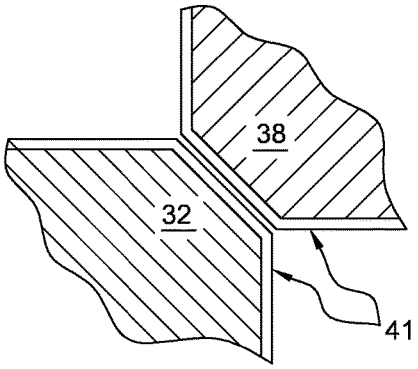
FIG. 4 and FIG. 5 show enlarged views of elements of FIG. 3*a;*

FIG. 4 is an enlarged view of the chamfers 32 and 38. This view shows that in the example described, the bodies 12 and 22 are covered with a coating 41 of ceramic preferably comprising $ZrO_2$ or, in a variation, $Al_2O_3$ or $Cr_2O_3$. In other embodiments, other coatings can be used. In a variation, the coating 41 could be omitted. Among other advantages, the coating 41 may be used to accurately control the dimension of the spaces 39 and 40. Optionally or as an alternative, the bodies 12 and 22 may be covered with an added-on part.

In the example described here, the arm 14 and the arm 24 have a length of 9.3 mm, and a width of 1.6 mm. In this same example, the arm 16 and the arm 26 have a length of 5.6 mm and a width of 1.6 mm. The chamfers 32, 34, 36 and 38 are produced with an angle of 45° from a point located at a distance of 0.6 mm from the outermost edge of the end surface of each arm 14, 16, 24 and 26.

As can be seen in FIG. 3*a*, in cross section, the windings 20 and 30 each have four strips of copper or turns with references 42 to 45 and 46 to 49 respectively.

Figure 5:
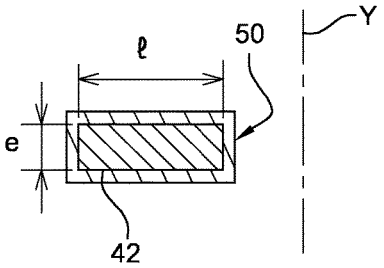

FIG. 5 is an enlarged view showing the section of one of the strips 42 to 49. As can be seen in this Figure, each strip has a thickness "e" of 200 μm and is completely covered with a 50 μm thick insulating coating 50. In other embodiments, the thickness "e" of the strips could be in the range 33 μm to 500 μm. The thickness may also be constant along the winding, namely have a thickness that has a plus or minus 10% variation with respect to a mean value. In the example described here, the coating 50 is a polyester/polyamideimide resin. In other embodiments, this coating could be produced from ceramic, Kapton® or another electrically insulating, flexible material. In other embodiments, the thickness of the coating 50 may be in the range 10 μm to 100 μm. In a variation, this coating could be omitted. Each strip has a width "l", which is greater than the thickness "e", in the range 132 μm to 2 mm, in particular of the order of 800 μm.

The strips 42 to 45 and respectively 46 to 49 are spaced from each other by 450 μm. As mentioned above, the bodies 12 and 22 have shapes such that the windings 20 and 30 are substantially parallel. In particular, as can be seen in FIGS. 3*a*, 3*b*, 3*c* and 3*d*, a turn is spaced from the adjacent turn by a distance "d" which is, for example in the range 10 μm to 450 μm, for example of the order of 150 μm. Preferably, this spacing is substantially constant along the whole winding.

As illustrated in FIG. 3*b*, the winding 20 (respectively 30) comprises turns, in this case four, visible in FIG. 3*a* in the form of strips viewed in cross section. The turns are electrically continuous. One turn is connected to the next via an offset diagonal portion 43*a* and 44*a* disposed on a cylinder. The ends of the turns at the edges, in this case rows one and four, are provided with a connection pin. At the diagonal offset portions 43*a* and 44*a*, the width "l" is greater than at other sections. Assuming the nominal width to be "ln", measured at any point perpendicular to the trajectory of the track, this nominal width "ln" of the track is substantially constant along the winding, i.e. it has a nominal width varying between plus and minus 10% with respect to a mean value. The mean value of the nominal value "ln" is, for example, in the range 130 μm to 2 mm; in particular, it is of the order of 800 μm.

In fact, the electromagnetic coupler 10 can advantageously be produced in a more accurate manner. In this case, not only are the windings 20 and 30 parallel but, as can be seen in FIG. 3*a*, the strips or turns which form these windings are substantially face to face. More particularly again, the transverse sections of the front faces 70 of the strips or turns directly facing each other are selected to be parallel, as can be seen in FIGS. 3*a*, 3*d*, 9, 10, 11 and 14. In the context of the invention, the transverse section is made in a sectional plane passing through the longitudinal axis X of the tubular component and containing a radius of the tubular component. Alternatively, they may have the same concavity or the same convexity facing each other.

Thus, the strip 42 is parallel to and facing the strip 46, the strip 43 is parallel to and facing the strip 47, the strip 44 is parallel to and facing the strip 48, and the strip 45 is parallel to and facing the strip 49.

In the assembled position of the support elements 2 and 4, when the windings 20 and 30 are flat, they are disposed such that their respective axial projection along a winding axis Y onto a plane perpendicular to this winding axis are superimposed by more than 90%, or even by more than 97%, as can be seen in FIG. 3*e*. In fact, as can be seen in FIG. 3*e*, the fact that the winding is not helical but composed of open circular turns connected by deflections, allows for optimized superimposition. Incomplete superimposition of the turns only occurs in zones Z1 and Z2 corresponding to the respective placements of said deflections.

When the windings 20 and 30 are concentric, the radial projection of the internal winding onto the external winding produces a degree of superimposition of the windings of the order of 90%, or even more than 97% because of the geometry selected for these windings, as can be seen in FIG. 3*b*.

Such a geometry in the invention guarantees a reproducible degree of superimposition of the projections of the turns without necessitating angular indexation of the winding in its support element, nor even an angular indexation of said support element on the tubular component. Manufacture of the assembly of the invention is thus facilitated, while preserving the quality of signal transmission by optimizing and controlling the capacitive effect over the entire length of the drill string, and indeed at each of the connections between two tubular components.

In the example described here, the strips of the winding 20 and the strips of the winding 30 are separated by a distance D of 2.6 mm. When the windings 20 and 30 are cylindrical, the distance D is measured radially relative to the winding axis Y. When the windings 20 and 30 are flat, the distance D is measured along the winding axis Y.

In fact, in order to protect the windings 20 and 30 against a liquid or another element which could be introduced via the spaces 39 and 40 into the space 31, each winding 20 and 30 is covered with a layer of material 51, preferably comprising 1 mm thick $Al_2O_3$. This material 51 may be an adhesive that can also fix the winding in its respective annular body 12 or 22. In other embodiments, this layer may be omitted.

The winding 20 (respectively 30) illustrated in FIG. 3*c* is generally annular in shape. The turns are concentric. One turn is connected to the next via an offset diagonal portion 43*a* and 44*a* disposed in a radial plane. The ends of the turns at the rim, in this case rows one and three, are provided with a connecting pin.

The winding illustrated in FIG. 3*c* may be used when the winding 20 (respectively 30) is disposed along the arm 16 (respectively 26) instead of the arm 14 (respectively 24) as is the case in FIG. 3*d*. The winding 20 (respectively 30) is then essentially flat, and FIG. 3*c* is a face view of the winding. FIG. 3*c* corresponds to an example of a winding which is employed in the embodiment shown in FIG. 2*b*.

FIG. 3*d* shows a variation of the coupler illustrated in FIG. 3*a*. FIG. 3*d* shows an embodiment of the coupler of the invention which may be employed in the embodiment shown in FIG. 2*b*. In this variation, the bodies 12 and 22 each have a general form of a square bracket or "[" or "U", and the winding 20 (respectively 30) is disposed along the longest side of the square bracket.

Figure 13:
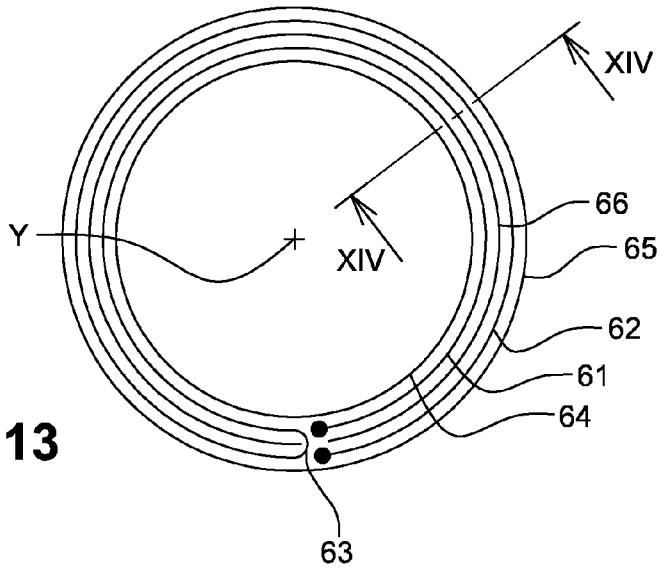
FIG. 13 shows a top view of a third embodiment of a conductive winding in a support element for an assembly of the invention.
Figure 14:
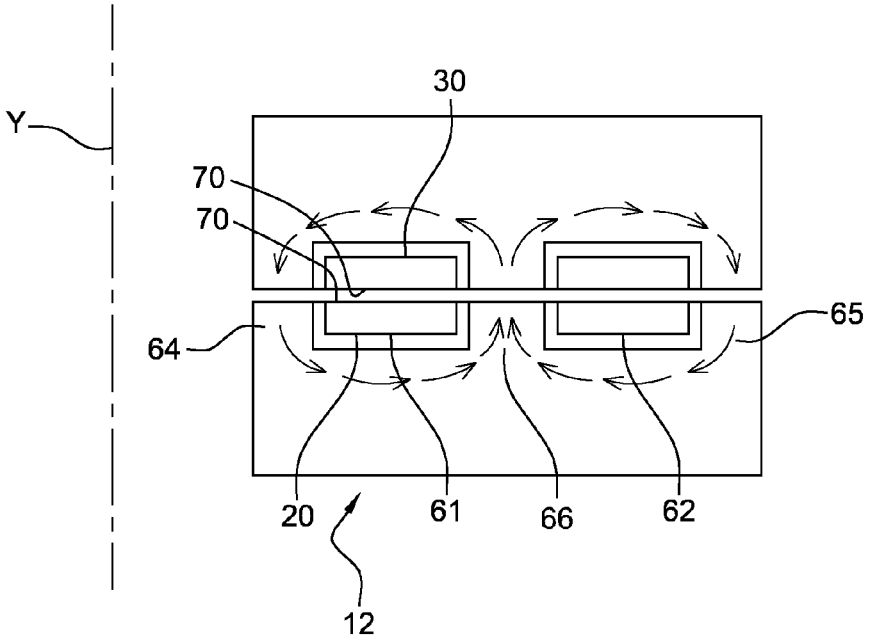
FIG. 14 shows a diagrammatic view of the field lines in the sectional plane XIV-XIV of FIG. 13

FIG. 13 shows a top view of a flat winding 20 comprising two concentric turns 61 and 62 connected together via a radial deflection 63, the turns 61 and 62 being produced so that they cover an angular arc strictly less than 360°. The orientation of the internal turn is said to be reversed relative to the orientation of the external turn 62. In particular, this winding is received in a body having a longitudinal section comprising the axis of revolution Y, which is E-shaped. The winding is bordered by a radially internal arm 64 of said body 12 and also by a radially external arm 65. In addition, the body comprises a central arm 66 which is arranged parallel to the other two arms 64 and 65 along the axis Y and disposed between the turn 61 and the turn 62. This configuration means that the solidity of the coupler and its resistance to compressive loads exerted along the axis of revolution Y is reinforced. In FIG. 14, the winding 20 of FIG. 20 is shown facing the winding 30, configured in a manner identical to that of the winding 20.

Preferably, the windings 20 and 30 have an identical number of turns.

Figure 6:
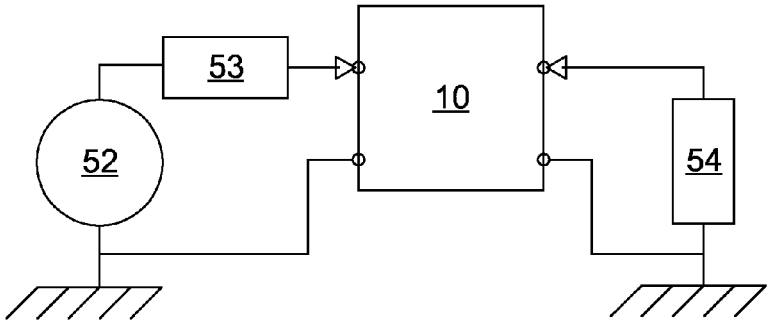
FIG. 6 shows a block diagram of an electrical circuit used to determine the properties of the electromagnetic coupler of FIG. 1*d;*

FIG. 6 shows an experimental electrical arrangement used to determine the performances of the electromagnetic coupler 10. As can be seen in this figure, the circuit comprises, on the emitter side, the body 12 which is in series with an alternating voltage source 52 and an impedance 53 of 50 ohms, and on the receiver side, the body 22 is in series with a load impedance 54 of 50 ohms; the connections are via the pins for the windings 20 and 30.

The magnetic coupler proposed here uses a physical phenomenon the effects of which were a surprise to the Applicant. The particular disposition of the windings and their confinement in the space defined by the ferrite body result in a non-linear combination of a capacitive effect and an inductive effect which results in excellent transmission performance.

Figure 7:
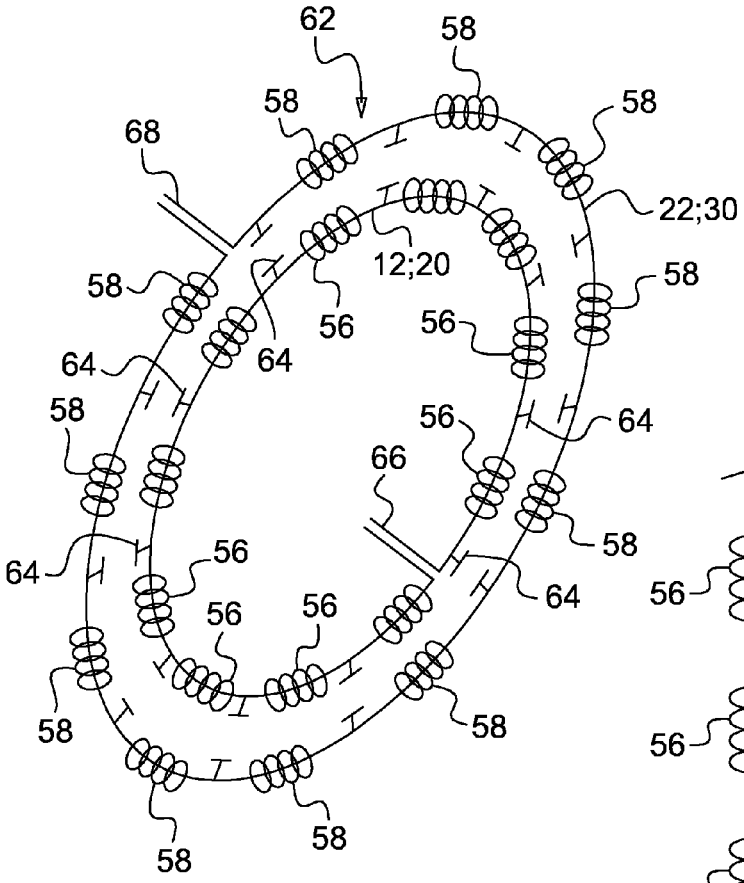
FIG. 7 shows a block diagram of the magnetic coupler of FIG. 1*d;*
Figure 8:
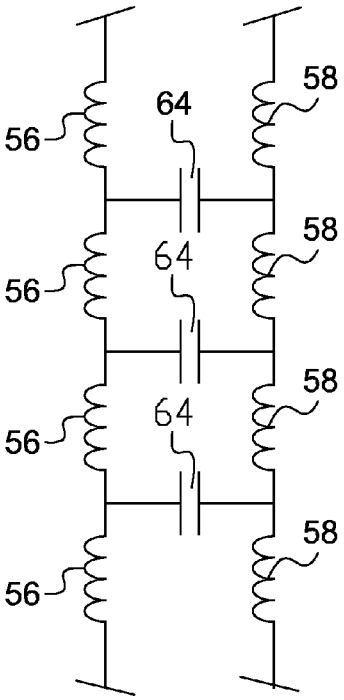
FIG. 8 shows an electrical model drawn from the block diagram of FIG. 5.

FIGS. 7 and 8 are provided in order to provide a better understanding of the effect observed. As can be seen in FIG. 7, the body 12 provided with the winding 20 (respectively the body 22 provided with the winding 30) can be represented as a plurality of coils 56 (respectively 58) connected together to form a ring 60 (respectively 62). However, since the rings 60 and 62 are close together and have flat, facing conductive surfaces, capacitances 64 are shown between them. The wires 66 and 68 providing the electrical connection to the coupling element 6 and to the coupling element 8 are also diagrammatically represented. FIG. 8 represents an electrical model of the electromagnetic coupler 10 which represents an "unwound" view of FIG. 7. This model has been used to carry out simulations the results of which have been validated experimentally.

Figure 9:
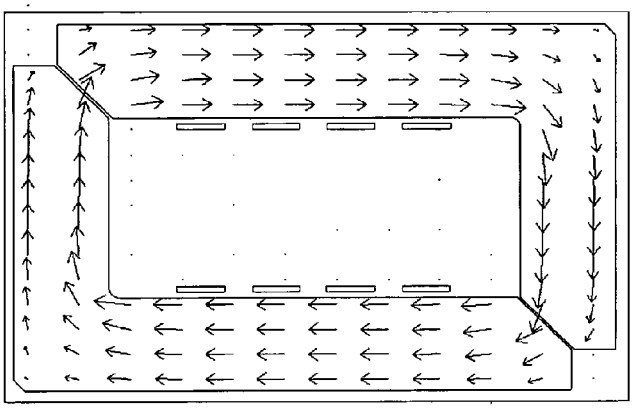
FIG. 9 shows the magnetic field lines that flow in the electromagnetic coupler of FIG. 1*d* when an electric current with a frequency of 1 kHz passes through it.

Thus, FIG. 9 shows the magnetic field lines which move in the electromagnetic coupler of FIG. 3*a* when an electric current with a frequency of 1 kHz passes through it. In this Figure, the direction of each arrow is representative of the direction of the magnetic field at the point under consideration, and the length of each arrow is representative of the intensity of the magnetic field at that same point. As can be seen in this Figure, the magnetic field lines are concentrated in the body 12 and in the body 22.

Figure 10:
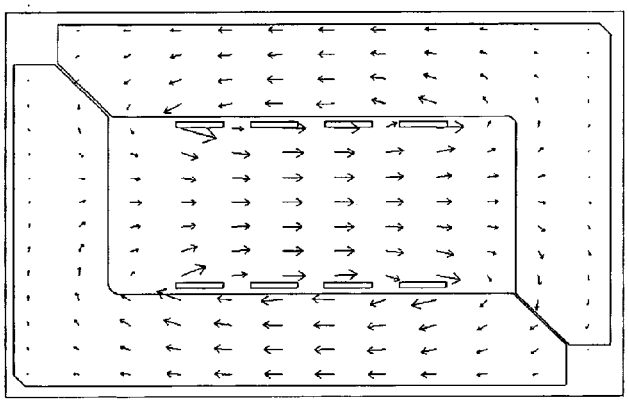
FIG. 10 shows the magnetic field lines that flow in the electromagnetic coupler of FIG. 1*d* when an electric current with a frequency of 100 kHz passes through it.

Experiments have shown that when the frequency of the current approaches 400 kHz, the phase of the magnetic field reverses. FIG. 10 is the result of a simulation in which the frequency of the current is 100 kHz. In this Figure, the direction of each arrow is representative of the direction of the magnetic field at the point under consideration, and the length of each arrow is representative of the intensity of the magnetic field at that same point. The magnetic field lines are then concentrated at the edges of the body 12 and the body 22, and pass into the core of the space 31. Having done this, these magnetic field lines "wind up" around the strips 42 to 49, maximizing the benefit of the skin effect as they are very flat.

Figure 11:
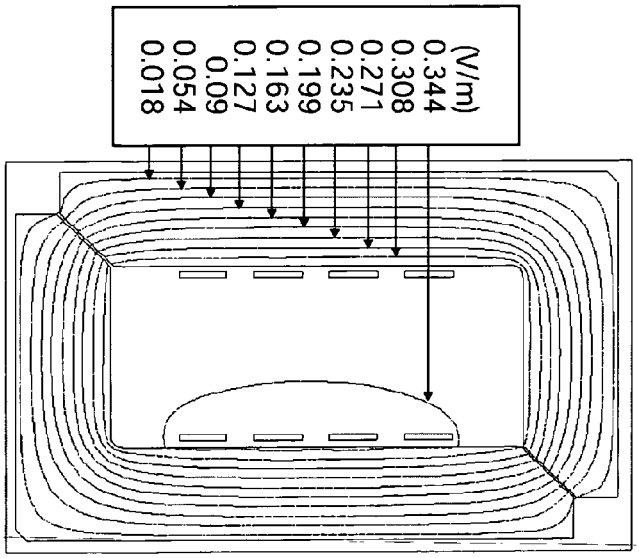
FIG. 11 represents the transfer of electric charge density which takes place in the coupler of FIG. 1*d* when an electric current with a frequency of 800 kHz passes through it.

Finally, as can be seen in FIG. 11 which represents the transfer of electrical charge density which takes place with an electric current with a frequency of 800 kHz, the change in the magnetic field favours capacitive transfer from bands 42 to 45 to bands 46 to 49. The values facing the arrows indicate the value of the electric field in V/m along the contours to which the arrows point.

Figure 12:
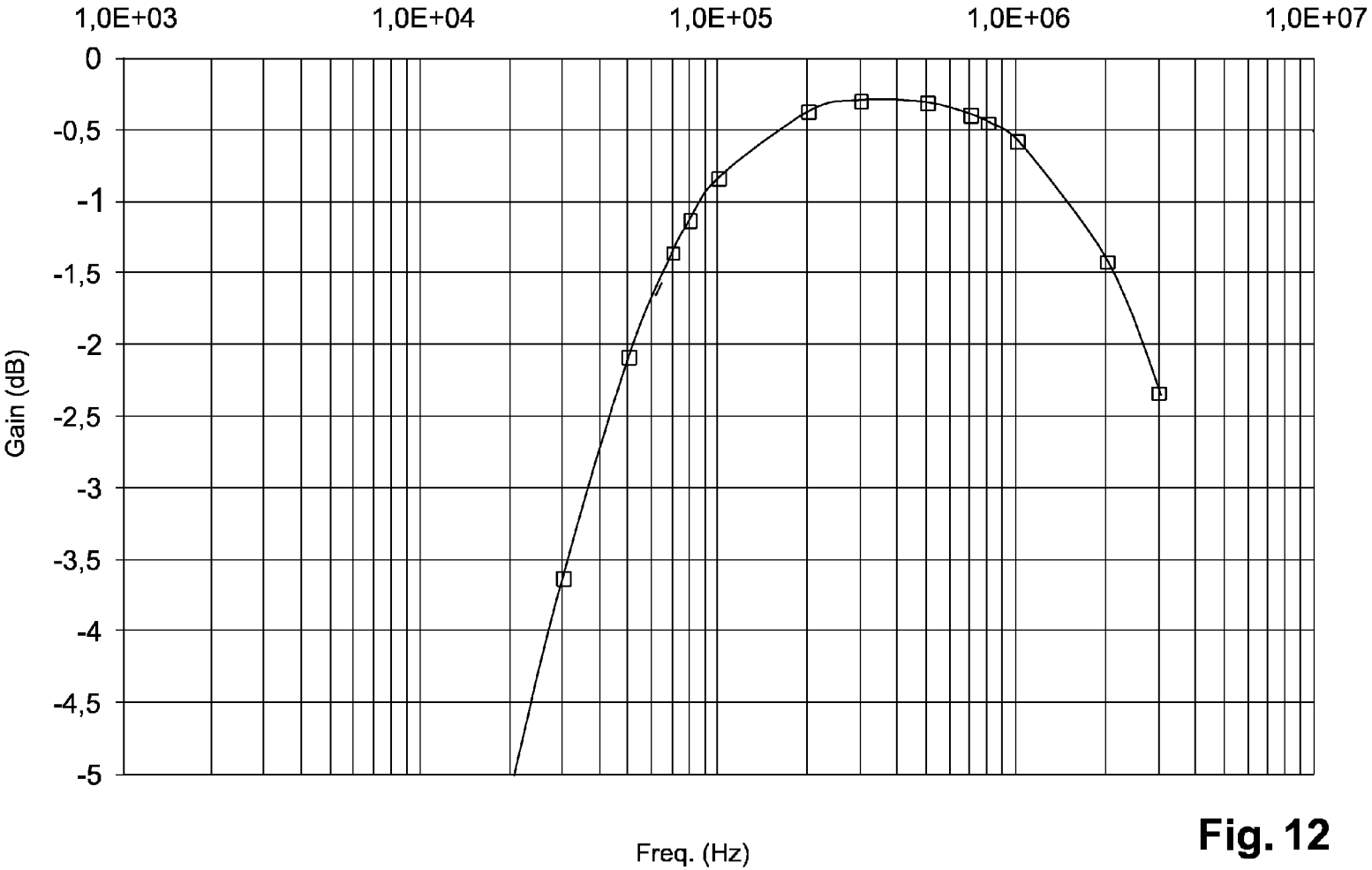
FIG. 12 shows a graph of the transmission level for the electromagnetic coupler of FIG. 3*a;*

FIG. 12 shows the graph of the degree of transmission of the coupler of FIG. 1. As can be seen in this Figure, the available transmission band at [−1.5 dB, 0] gain is in the range approximately 60 kHz to approximately 2 MHz.

Because of the performances of this coupler, it is possible to transmit data via GMSK (Gaussian Minimum Shift Keying) modulation over wide 100 kHz frequency bands in the 100 kHz-2 MHz band. Other types of modulation could be used, in particular any type of frequency modulation.

It is advantageous to avoid the 350 kHz-450 kHz band because of the magnetic field phase inversion. Studies by the Applicant have shown that by optimizing the parameters, it is reasonably easy to obtain a working transmission band in the range 8 MHz to 10 MHz.

Physically, it would appear that the particular magnetic field of the electromagnetic coupler 10 "shields" the capacitances formed by the windings, thus improving the transmission gain.

Experiments by the Applicant have demonstrated that the performance of the electromagnetic coupler 10 depends on several parameters.

One parameter is the number of turns in each winding. The greater the number of turns, the lower the frequency above which the gain is satisfactory.

Another parameter is the alignment of the turns between themselves. It is important that the turns are properly aligned facing each other in order to avoid loss of energy. Currently, the Applicant assumes that these "non-alignment" losses are due to losses of capacitive transfer.

Another parameter is the spacing between the turns. In fact, the closer they are, the higher is the risk of an unwanted inter-turn capacitive effect. However, because of the very "flat" shape of the strips of the windings, the Applicant has discovered that maximizing the "conductive space" available on each body is of advantage in order to increase the capacitive transfer. Conductors which are generally not flat but have a flat surface may be used, but the best results are currently obtained with flat conductors.

Another parameter is the spacing between the chamfers 32, 34, 36 and 38 of the bodies 12 and 22. The best yields are obtained when the respective chamfers of the bodies are in contact with each other. This means that a maximum magnetic permeability can be obtained, which leads to optimized transmission. In contrast, this causes problems as regards reproducibility on an industrial scale. The graph of magnetic permeability as a function of the distance between the chamfers of the bodies varies greatly between 0 and 100

μm. However, this distance generally results from engaging the reception elements which receive the coupling elements. And if several magnetic couplers 10 are in series, and they have different magnetic permeabilities, a phenomenon of impedance mismatch occurs which results in almost total loss of signal. Consequently, the Applicant has determined that in applications in which several magnetic couplers are in series, the spacing should advantageously be in the range 100 μm to 500 μm, with a controlled distance range for mounting the support elements together, and in which the magnetic permeability varies only slightly.

Another parameter is the shape of the bodies 12 and 22. The bodies 12 and 22 in the example described above have an "L" section where one of the arms is very small with respect to the other. However, numerous other shapes are possible. Thus, studies by the Applicant have shown that a square bracket or "[" section shown in FIG. 3*d* or its equivalent rotated by 90° performs particularly well, the windings being housed between the parallel arms. This shape facilitates the positioning of the coupling elements with respect to each other and offers a naturally shortened space between the respective windings. Other sections may be envisaged, such as an "E", "J" or "V" section, or any other section which can define a flat space which confines the windings while disposing them close to each other in a substantially parallel manner.

In particular, the embodiment of FIG. 13 has a support element with an E-shaped section such that a first turn is spaced from a second turn by a bridge of material formed by the support element, in particular the "central arm of the E".

Another parameter is the use of a coating for the bodies 12 and 22. Studies by the Applicant regarding the use of an electromagnetic coupler 10 in the oil drilling field have shown that is advantageous to coat the bodies with a ceramic preferably comprising $ZrO_2$ or, in a variation, with $Al_2O_3$. These coatings are more resistive than the material of the bodies, which can improve the transmission gain. It is also possible to use $Cr_2O_3$. Other coatings or added parts could be used. The added-on part may be massive, for example cut from a single piece.

Another parameter is the composition of the annular bodies. These do not have to be produced entirely from ferrite. It is possible to form the ring segments from ferrite and to dispose them on an annular support, for example an elastomer such as silicone, a HNBR (hydrogenated nitrile rubber), a FKM (fluoroelastomer), a FFKM (perfluoroelastomer), or an EPDM (ethylene-propylene-diene monomer). The windings are housed in an identical manner. This renders the manufacture of the bodies 12 and 22 easier and the elastomer means that the body 12 and 22 is better able to tolerate environmental stresses. In one embodiment, the annular support may be rigid compared with the above. The annular support may include titanium and/or amagnetic stainless steel, and/or zirconia.

The above described list of parameters is not exhaustive.

The Applicant has thus described an electromagnetic coupler comprising a first coupling element for mounting on a first support element and a second coupling element for mounting on a second support element. The first coupling element comprises a first annular body formed at least in part from a high magnetic permeability material which houses a first conductive winding and which has an open transverse section, and the second coupling element comprises a second annular body formed at least in part from a high magnetic permeability material which houses a second conductive winding and which has an open transverse section.

The first body and the second body have complementary shapes such that when two support elements respectively receiving the first coupling element and the second coupling element are coupled, the first body and the second body form a structure encircling the first conductive winding and the second conductive winding. The first conductive winding and the second conductive winding are respectively positioned in the first body and in the second body such that the respective surfaces of the first conductive winding and the second conductive winding are substantially parallel when two support elements respectively receiving the first coupling element and the second coupling element are coupled.

The Applicant has also described an electromagnetic coupler comprising first and second coupling elements each capable of being disposed at the end of a support element and comprising an annular body formed from a high magnetic permeability material, said bodies having complementary shapes, such that the first and second coupling elements can be coupled to form a magnetic circuit, said first and second coupling elements comprising respective windings defining between them a capacity of more than 2 pF when the first and second coupling elements are coupled.

The Applicant has also described an electromagnetic coupler comprising first and second coupling elements each capable of being disposed at the end of a support element and comprising at least one substantially flat electrode, the first and second coupling elements being capable of being coupled to form a capacitance, said first and second coupling elements further each comprising a respective annular body formed from a high magnetic permeability material, said bodies having complementary shapes and being arranged such that they form a magnetic circuit confining the capacitance when the first and second coupling elements are coupled.

The invention claimed is:

1. An assembly of at least two tubular drill string components for drilling a hole with movement of a drilling fluid, comprising:

a first tubular component comprising a first end including a first threading;

a second tubular component comprising a second end including a second threading configured to cooperate with the first threading in a coupled state; and an electromagnetic coupler comprising a first coupling element for mounting on a first support element disposed at the first end and a second coupling element for mounting on a second support element disposed at the second end;

the first coupling element comprising a first annular body formed at least in part from a high magnetic permeability material which houses a first conductive winding within an open cross-section;

the second coupling element comprising a second annular body formed at least in part from a high magnetic permeability material which houses a second conductive winding within an open cross-section;

the first body and the second body having complementary shapes such that when two support elements respectively receiving the first coupling element and the second coupling element are coupled, the first body and the second body form a structure enclosing the first conductive winding and the second conductive winding;

the first conductive winding and the second conductive winding being respectively positioned in the first body and in the second body such that respective surfaces of the first conductive winding and the second conductive winding are substantially parallel when two support elements respectively receiving the first coupling element and the second coupling element are coupled.

2. An assembly according to claim 1, in which the first conductive winding includes a substantially flat surface facing an opening of the open cross-section of the first body, the second conductive winding includes a substantially flat surface facing an opening of the open cross-section of the second body, and in which the windings are flat and mutually parallel when the first tubular component is coupled to the second tubular component.

3. An assembly according to claim 1, in which the first conductive winding includes a substantially cylindrical surface, the second conductive winding includes a substantially cylindrical surface, and in which the windings are concentric when the first tubular component is coupled to the second tubular component.

4. An assembly according to claim 1, in which the open cross-section of at least one of the first body and the second body has a general shape selected from the group of a square bracket, an "L", a "J", an "E", or a "V".

5. An assembly according to claim 1, in which the first body and the second body includes respective end chamfers, and in which the chamfers of the first body are substantially facing at least certain of the chamfers of the second body when two support elements respectively receiving the first coupling element and the second coupling element are coupled.

6. An assembly according to claim 1, in which the surfaces of the first body and the second body which are facing when two support elements respectively receiving the first coupling element and the second coupling element are coupled are at a distance from each other is in a range of 100 μm to 500 μm.

7. An assembly according to claim 1, in which the first conductive winding and the second conductive winding comprise a conductor selected from the group of a copper winding, a copper winding coated with an insulating coating, a printed circuit, or a printed circuit coated with an insulating coating.

8. An assembly according to claim 1, in which the first conductive winding and the second conductive winding comprise an identical number of turns in a range of 1 to 10 in cross section.

9. An assembly according to claim 1, in which turns or strips of the first conductive winding are substantially superimposable with turns or strips of the second conductive winding when two support elements respectively receiving the first coupling element and the second coupling element are coupled.

10. An assembly according to claim 1, in which at least one of the first and second conductive windings, or both of the first and second conductive windings, comprises two turns with reversed orientations disposed in a body comprising at least one arm between the two turns.

11. An assembly according to claim 1, which the first conductive winding and the second conductive winding are at a distance in a range of 0.5 mm to 5 mm from each other when two support elements respectively receiving the first coupling element and the second coupling element are coupled.

12. An assembly according to claim 1, in which at least one of the first conductive winding and the second conductive winding is coated with a coating comprising a ceramic comprising $Al_2O_3$.

13. An assembly according to claim 1, in which the high magnetic permeability material has a relative magnetic permeability of more than 100, or more than 300, in the 1 kHz to 10 MHz band.

14. An assembly according to claim 13, in which the high magnetic permeability material is formed from a ceramic comprising MnZn.

15. An assembly according to claim 14, in which the high magnetic permeability material is a soft ferrite.

16. An assembly according to claim 1, in which the first body includes the first conductive winding within the open cross-section such that the first body does not enclose the first conductive winding and the second body includes the second conductive winding within the open cross-section such that the second body does not enclose the second conductive winding.

17. An assembly according to claim 1, in which the open cross-section of the first body is open at least longitudinally relative to an axis of revolution of the first body and the open cross-section of the second body is open at least longitudinally relative to an axis of revolution of the second body.

18. An assembly according to claim 17, in which the open cross-section of the first body is also open radially relative to the axis of revolution of the first body and the open cross-section of the second body is also open radially relative to the axis of revolution of the second body.

19. An assembly according to claim 1, in which the first body and the second body form the structure enclosing the first conductive winding and the second conductive winding with the first conductive winding and the second conductive winding being open to each other within the structure.

* * * * *